US011746781B2

(12) United States Patent
Savage et al.

(10) Patent No.: US 11,746,781 B2
(45) Date of Patent: Sep. 5, 2023

(54) SERVICEABLE FLUID PUMP

(71) Applicant: PITCO FRIALATOR, INC., Bow, NH (US)

(72) Inventors: Steven Savage, Concord, NH (US); Steven J. Cyr, Londonderry, NH (US)

(73) Assignee: PITCO FRIALATOR, INC., Bow, NH (US)

( * ) Notice: Subject to any disclaimer, the term of this patent is extended or adjusted under 35 U.S.C. 154(b) by 87 days.

(21) Appl. No.: 16/848,976

(22) Filed: Apr. 15, 2020

(65) Prior Publication Data

US 2020/0332796 A1 Oct. 22, 2020

Related U.S. Application Data

(60) Provisional application No. 62/834,459, filed on Apr. 16, 2019.

(51) Int. Cl.
*F04C 15/00* (2006.01)
*F04C 2/08* (2006.01)

(52) U.S. Cl.
CPC ..... *F04C 15/0003* (2013.01); *F04C 2/082* (2013.01); *F04C 15/0088* (2013.01); *F04C 15/0096* (2013.01); *F04C 2210/1038* (2013.01); *F04C 2240/81* (2013.01)

(58) Field of Classification Search
CPC .. F04C 15/0003; F04C 2/082; F04C 15/0088; F04C 15/0096; F04C 2210/1038; F04C 2240/81; F04C 2/084; F04C 2210/1088
See application file for complete search history.

(56) References Cited

U.S. PATENT DOCUMENTS 3,459,430 A * 8/1969 Ball ..... F04D 29/108 277/374
4,439,096 A * 3/1984 Rockwood ..... F04D 29/126 415/230
4,478,140 A * 10/1984 Bullock ..... A47J 37/1214 99/330
4,501,530 A * 2/1985 Rockwood ..... F04D 29/622 415/230
4,859,161 A * 8/1989 Teruyama ..... F04C 2/086 418/102

(Continued)

FOREIGN PATENT DOCUMENTS

DE 8510923 U1 6/1985
WO WO0201072 A1 1/2002

*Primary Examiner* — Bryan M Lettman
(74) *Attorney, Agent, or Firm* — SEYFARTH SHAW LLP; Brian Michaelis

(57) ABSTRACT

A serviceable pump includes a motor disposed at an end of the serviceable pump and connected to a gear portion with a pump shaft. The gear portion receives fluid from and outputs fluid to a system such as a deep fryer cooking system. The gear portion includes at least one channel for receiving fluid, such as oil, to lubricate the gears and a fluid discharge aperture to push fluid into a cooling loop at a first end of the cooling loop. The cooling loop cools the fluid passing through the serviceable pump and is disposed between the motor and the gear portion. The cooling loop is connected to a seal assembly that surrounds the pump input shaft at a second end of the loop. The seal assembly allows the cooled fluid to pass along the pump input shaft.

17 Claims, 12 Drawing Sheets

(56) References Cited

U.S. PATENT DOCUMENTS

| | | | | |
|---|---|---|---|---|
| 6,213,745 | B1 * | 4/2001 | Woodcock | F16C 33/1065 418/206.7 |
| 6,328,541 | B1 * | 12/2001 | Veronesi | F04D 29/5866 376/404 |
| 7,156,765 | B2 * | 1/2007 | Mano | F16H 57/0434 475/5 |
| 7,461,590 | B2 | 12/2008 | Marquet et al. | |
| 8,070,943 | B2 * | 12/2011 | Allen, Jr. | A47J 37/1223 210/167.28 |
| 8,497,691 | B2 * | 7/2013 | Behle | G01N 21/534 324/698 |
| 2007/0137497 | A1 * | 6/2007 | Savage | A47J 37/1223 99/403 |
| 2017/0095117 | A1 * | 4/2017 | Savage | B30B 9/067 |

* cited by examiner

SERVICEABLE FLUID PUMP

RELATED APPLICATIONS

This claims priority from U.S. Provisional Patent Application No. 62/834,459 filed Apr. 16, 2019, the entirety of which is incorporated herein by reference.

FIELD OF TECHNOLOGY

The present application relates to pumps, and in particular to a serviceable pump, for example for use with deep fryers.

BACKGROUND

Fluid pumps are subject to wear and tear, and are often used in harsh environments that may lead to degradation of pump components.

For example, in conventional frying equipment, fried foods are prepared using high temperature cooking oil contained in vats in the frying equipment. While using these conventional deep fryers to heat and cook foods, unwanted food debris is often formed while the foods are cooking. This food debris generally remains within the cooking oil or becomes stuck on the walls of the vats. When food debris is not removed from the cooking oil, the food debris affects the quality and cooking characteristics of the cooking oil.

Typically, the cooking oil contained in the vats of the frying equipment remain in the vats during operation of the frying equipment and the temperature of the oil is controlled by heating the oil. Frying equipment may use recirculating means to circulate the cooking oil through the deep frying system. Pumps are used to draw the cooking oil from the vats, e.g., for cleaning/filtering the oil, and returning the cooking oil to the vat. However, these pumps are difficult and expensive to service or maintain and ensure proper operation to continuously circulate the oil through the system.

SUMMARY

The present disclosure provides a serviceable pump, for example for use with deep frying systems that continuously circulate and filter a cooking medium such as cooking oil, from a frying vat. The serviceable pump as configured avoids degradation of the pump and pump components during operation. The disclosed serviceable pump is able to use the fluid, e.g., cooking oil, passing through the pump to maintain significant components of the pump at lower temperatures and lubricated in a manner that prolongs useful life of the pump components and pump. The disclosed serviceable pump reduces the negative effects normal operation may have on the mechanical components contained within the pump.

A serviceable pump assembly according to the disclosure may be implemented as part of a deep fryer system. The serviceable pump includes a motor disposed at a first end of the serviceable pump and connected to a gear portion disposed at an end of the pump distal to the motor. A pump shaft is disposed between the motor and the gear portion, and translates forces from the motor to the gear portion. The gear portion includes a plurality of interlocked gears and conduit(s) disposed within the gear portion to circulate oil through the gear portion. The gear portion receives oil from an oil suction line connected to a first side of the gear portion and outputs oil to the deep fryer cooking system using an oil discharge aperture connected to an oil discharge line. In addition, the gear portion includes at least one conduit or channel disposed under the gears for receiving oil to lubricate the gear shafts when oil is circulated through the gear portion.

Further, a cooling loop aperture is disposed substantially adjacent to the oil discharge aperture and receives oil to be pushed into the cooling loop at a first end of the cooling loop. The cooling loop may be adapted to cool oil passing through the serviceable pump and is disposed between the motor and the gear portion. The cooling loop is connected to a seal assembly that surrounds the pump input shaft at a second end of the loop. The seal assembly may have a seal cavity that allows the cooled oil to flow through the seal cavity and along the pump input shaft before the cooled oil returns to the gear portion through a top gear cavity.

Advantages of the present disclosure will become more apparent to those skilled in the art from the following description of detailed embodiments of the disclosure that have been shown and described by way of illustration. As will be realized, the disclosed subject matter is capable of other and different embodiments, and its details are capable of modification in various respects. Accordingly, the drawings and description are to be regarded as illustrative in nature and not as restrictive.

BRIEF DESCRIPTION OF THE DRAWINGS

Embodiments of devices, systems, and methods are illustrated in the figures of the accompanying drawings, which are meant to be exemplary and non-limiting, in which like references are intended to refer to like or corresponding parts, and in which.

DETAILED DESCRIPTION

The present disclosure provides a serviceable pump for circulating high temperature fluid, such as cooking oil, that may be used at temperatures between approximately 300 and 500 degrees Fahrenheit, e.g., in a deep fryer system.

In one exemplary use, the serviceable pump may be used to efficiently circulate cooking medium, such as cooking oil, within a controlled cooking system, such as a deep frying system or the like. The serviceable pump may provide a higher reliability way to circulate, filter, and control the temperature of the cooking oil while avoiding degradation of the pump and the pump components, and enhancing serviceability during the operational life of the controlled cooking system.

Figure 12:
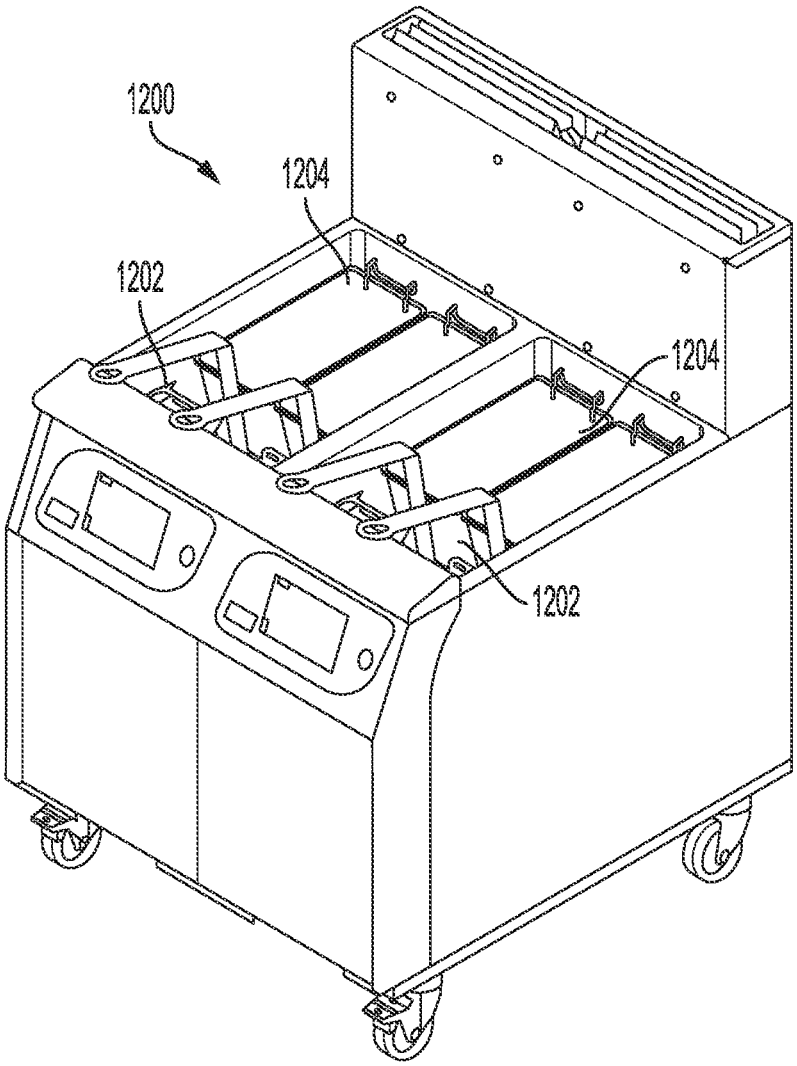
FIG. 12 illustrates an example of a controlled cooking system in which the serviceable pump according to the disclosure may be implemented.

A serviceable pump assembly according to the disclosure may be used to circulate high temperature fluids, such as cooking oil in a deep fryer cooking system 1200, illustrated in FIG. 12. In such an illustrative embodiment, the deep fryer may have a plurality of vats or frypots 1202 for containing the cooking oil for use in cooking food in the deep fryer 1200. The fryer vats, in operation, are filled with cooking oil that is heated to high temperature. The deep fryer 1200 has one of more fry baskets 1204, into which food is placed for cooking in the fryer. As is known in the art, as the cooking oil is used to cook food it may have particles of food fall into it that should be removed, so the cooking oil may be circulated out of the fryer vat for filtration/cleaning. A pump such as described herein may be used to circulate cooking oil from the fryer vat for filtration and back to the fryer vat after filtration. Again, it should be appreciated that the serviceable pump described herein may be implemented in other contexts to prolong operation and limit need for service of such a pump and system, such as in hot water or heating fluid circulation systems, deep fryer systems or the like.

FIGS. 1-5 illustrate the pump 100 may have a motor 102 at a first end configured to drive the operation of the pump 100. The motor 102 may be connected via a serviceable pump shaft to a gear portion 104 that is disposed at an end of the pump distal to the motor 102. The gear portion 104 may have an oil input/suction portion 106 connected to a first side of the gear portion 104 adapted to receive oil from an oil suction or circulation line connected with one or more of the vats of the deep fryer. Further, the gear portion 104 may also have an oil output/discharge portion 108 adapted to return oil to the vats through an oil discharge line and connected to an oil discharge aperture 110 on a second side of the gear portion 104. The gear portion 104 may also have a secondary discharge aperture 111, shown in FIG. 3, connected to a first end of a cooling loop 112 formed of coiled tubing. The secondary discharge aperture 111 may be adapted to receive a portion of oil from the gear portion 104 and transfer the received oil into the coiled tubing of the cooling loop 112. The cooling loop 112 may be adapted to pass the received oil through the tubing to lower the temperature of the oil. The cooling loop may be made of 3/16" coiled tubing. The cooling loop 112 may be stainless steel tubing, or tubing made of a similar material, and be approximately 5 feet to about 50 feet in length. The cooling by the cooling loop 112 may be a function of the length and diameter of the cooling loop 112 tubing. In the illustrative embodiment, the cooling loop 112 may be about 20 feet in length. It should be appreciated that the size and length of the tubing is not limited to such sizes and may be sized as a function of the amount of oil desired to be circulated through the cooling loop and/or pump. Additionally, fin cooling may be used along the cooling loop to shorten the length of the cooling loop in performing the cooling of the oil. The cooling loop tubing may be coiled around the pump (as shown), or it may be coiled along the length of the pump or a combination thereof.

A second end of the cooling loop 112 may be connected to a pump seal assembly 114 (best shown in FIGS. 4-8). The seal assembly 114, and a substantial portion of the pump shaft, may be surrounded by the coiled tubing of the cooling loop 112. As shown in greater detail in FIGS. 6 and 7, the pump seal assembly 114 may have a pump seal housing 130, a pump seal 132 and a pump drive shaft 116. The pump seal housing 130 may have cooling fins 136 around its perimeter and a seal cavity defined within the pump seal housing 130. The cooling fins 136 may be adapted to further cool the oil passing through the pump assembly 114. Further, the pump seal housing 130 may also have an inlet aperture 138 adapted to couple to the second end of the cooling loop 112 and receive oil from the cooling loop 112. The oil from the cooling loop 112 may be pushed into the pump seal housing 130 by pressure from oil transferred into the cooling loop 112 from the gear portion 104.

Once the cooled oil passes through the cooling loop 112 into the pump seal assembly 114, the cooled oil flows through the seal cavity and flushes the inside of the pump seal 132 and prevents buildup of materials on the pump seal 132. The cooled oil also flows along pump drive shaft 116, shown in FIGS. 6 and 7, that operatively connects the motor 102 to the gear portion 104. The pump drive shaft 116 may extend through the pump seal housing 130 and have a motor end **116*a* and a drive end 116*b*. The motor end 116*a* is operatively coupled to the motor 102. The drive end 116*b* is operatively coupled to the gear portion 104 and drives interlocked gears 122 within the gear portion 104. The oil that flows through pump seal assembly 114 along the pump drive shaft 116 may help limit degradation of the pump drive shaft 116 as the cooled oil (cooled by the cooling loop 112 and the pump seal housing 130) keeps the temperature of these critical pump components relatively lower during operation of the pump to continuously circulate, filter, and maintain temperature of the cooking oil and prevents buildup of materials on the pump seal 132 and the pump drive shaft 116** that can damage the pump seal assembly.

The pump seal 132 may be adapted to prevent oil from flowing out of the pump seal assembly 114. The cooking oil then reenters the gear portion 104 from the seal cavity through a drain groove 140 (best seen in FIG. 8) between the pump seal housing 130 and the pump drive shaft 116. In addition, there may also be a diametral clearance 142 (best seen in FIG. 8) between an inner diameter of the pump seal housing 130 and an outer diameter of the pump drive shaft 116 that is adapted to allow oil to flow along the shaft 116 and reenter the gear portion 104 from the pump seal assembly 114. The diametral clearance 142 may be, for example, a clearance of about 0.001 inches to about 0.002 inches. The cooking oil may reenter the gear portion 104 under suction from the gear portion 104.

Figure 1:
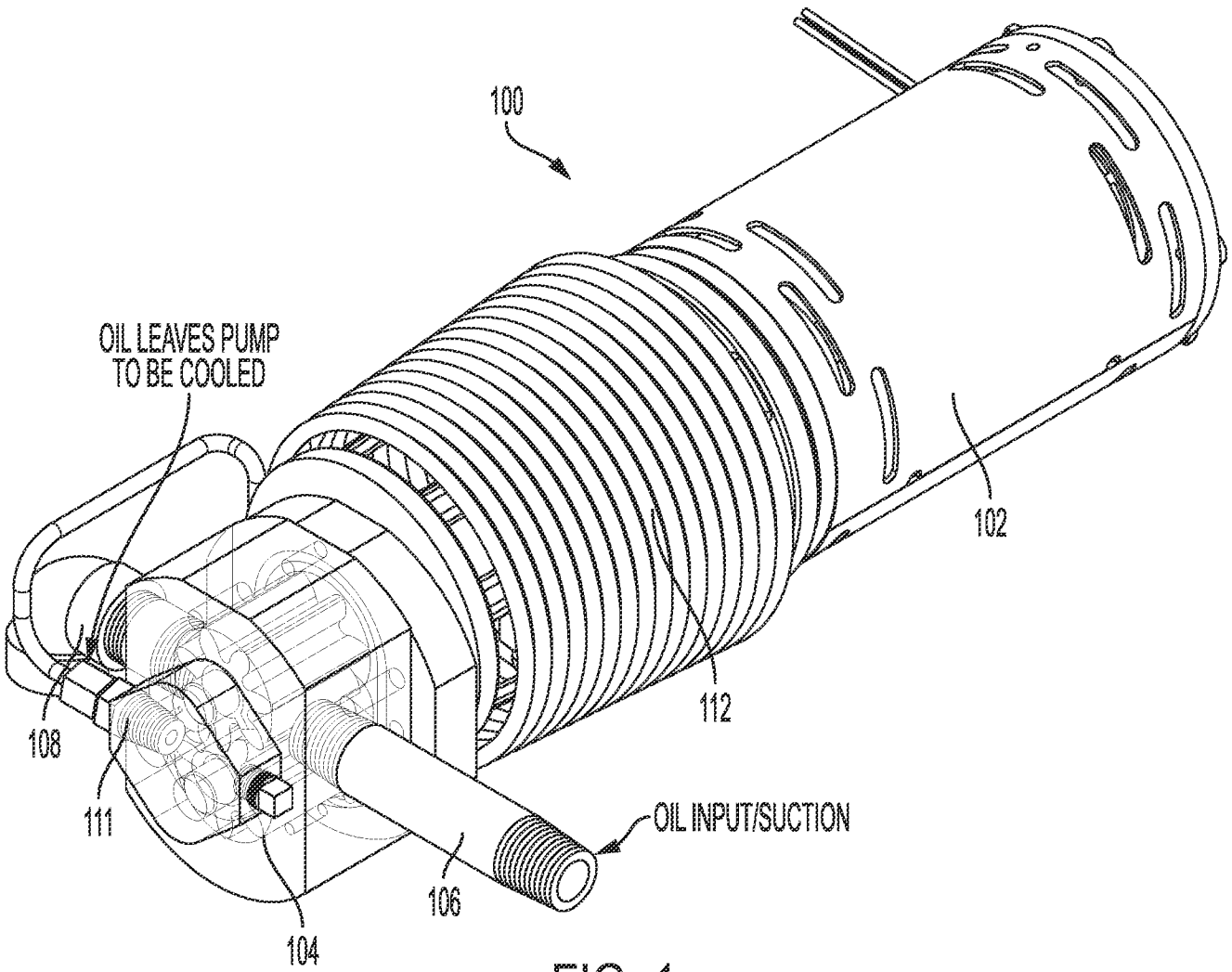
FIG. 1 is a first perspective view illustrating a serviceable pump, such as for use in a deep fryer system according to the disclosure.
Figure 2:
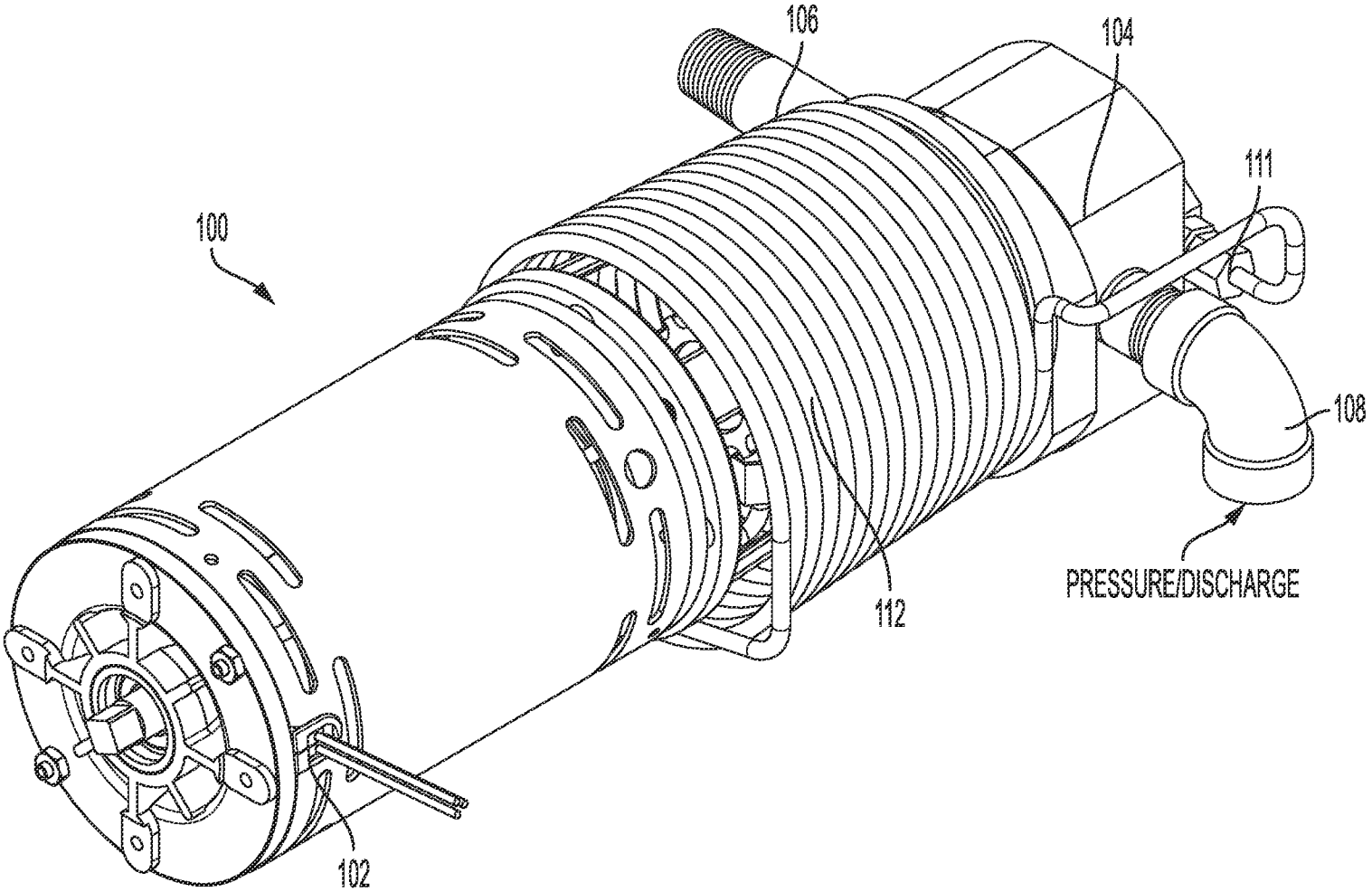
FIG. 2 is a second perspective view illustrating the serviceable pump for a deep fryer system according to the disclosure.
Figure 3:
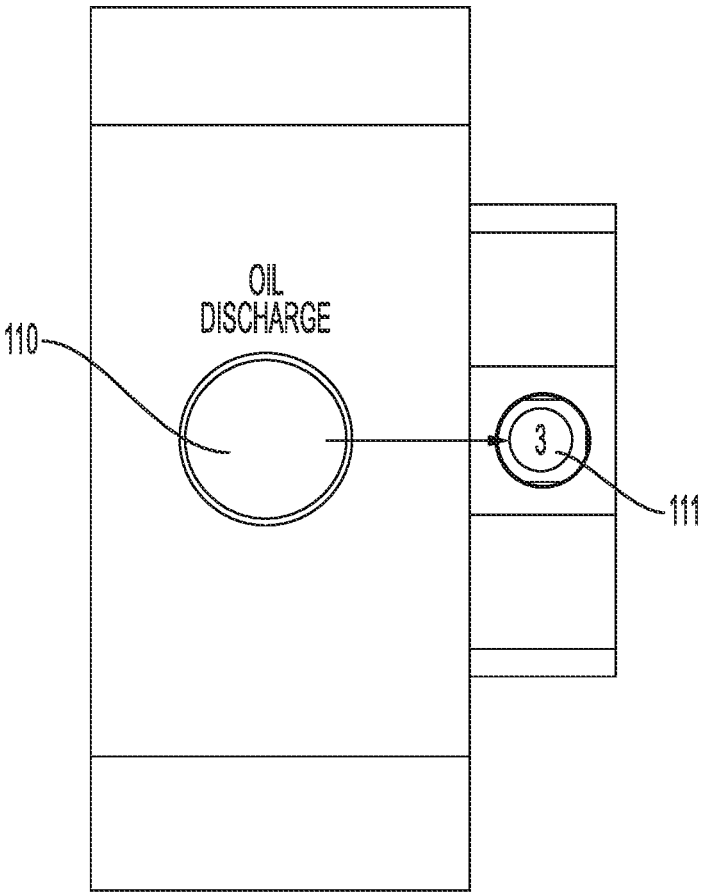
FIG. 3 is a detailed view of an oil discharge aperture and cooling loop aperture from the top gear of the serviceable pump of FIG. 1 according to the disclosure.
Figure 4:
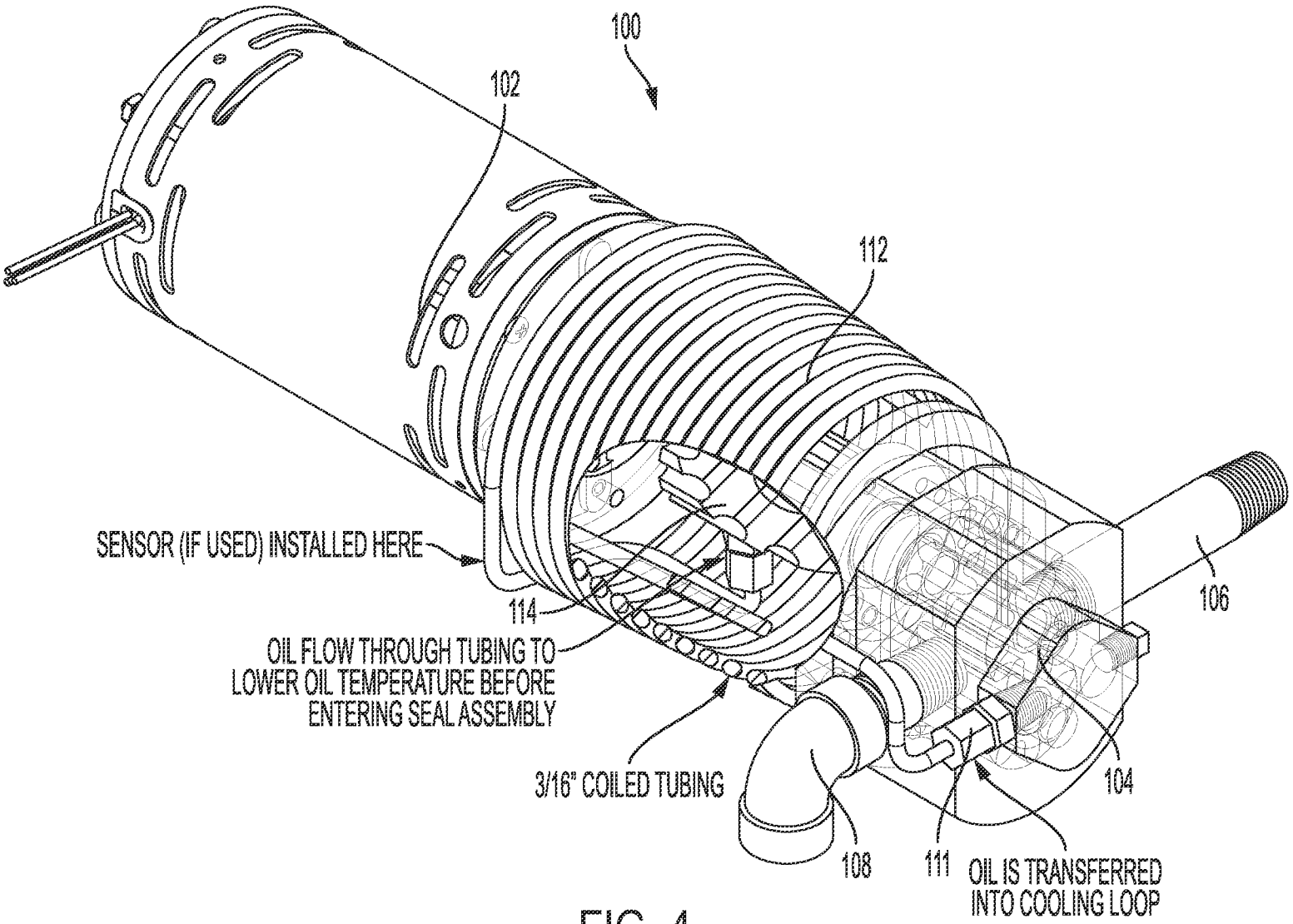
FIG. 4 is a third perspective and partially sectioned view illustrating a serviceable pump for a deep fryer system according to the disclosure.
Figure 5:
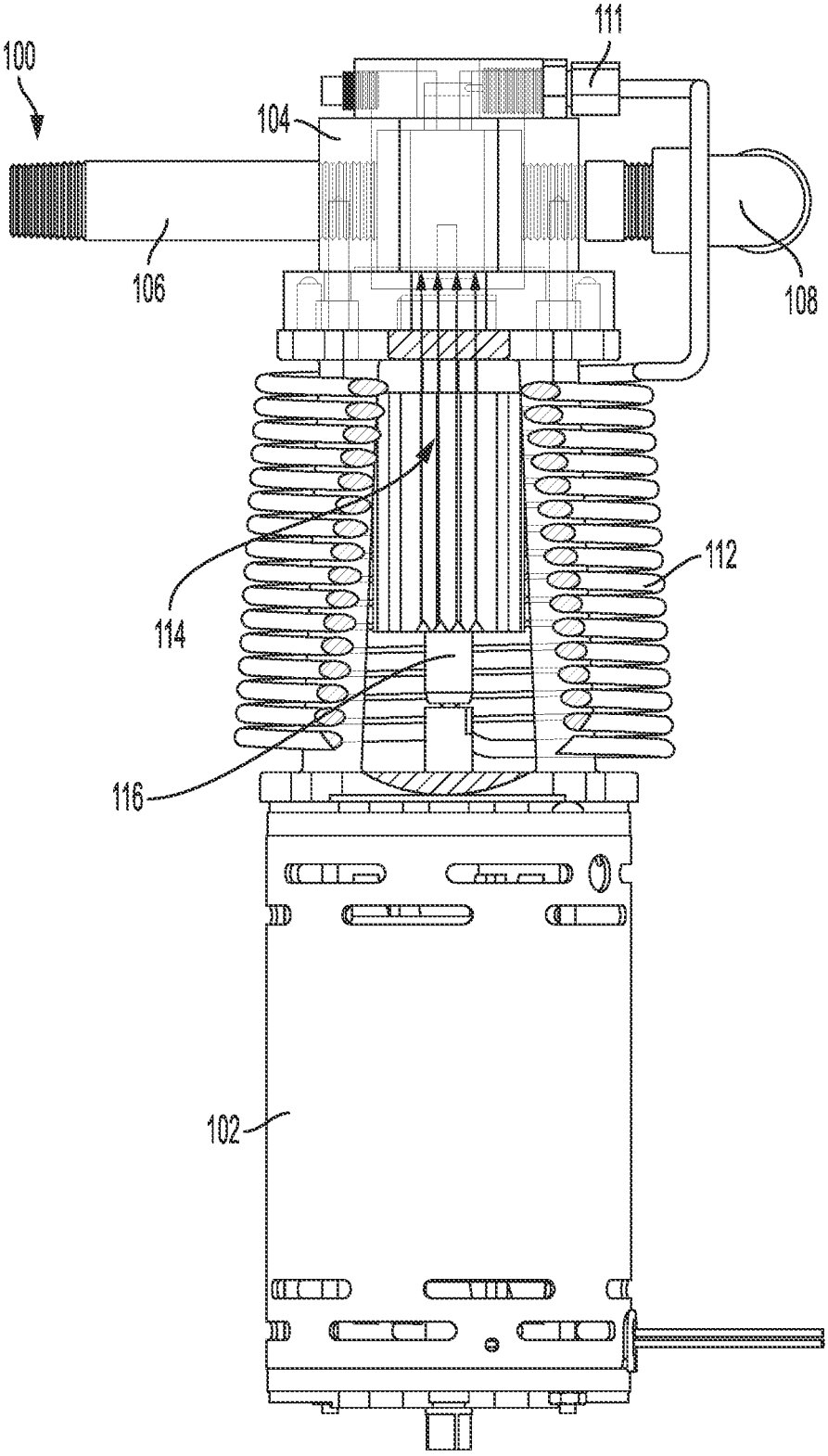
FIG. 5 is a plan partially sectioned view illustrating a serviceable pump for a deep fryer system according to the disclosure.
Figure 6:
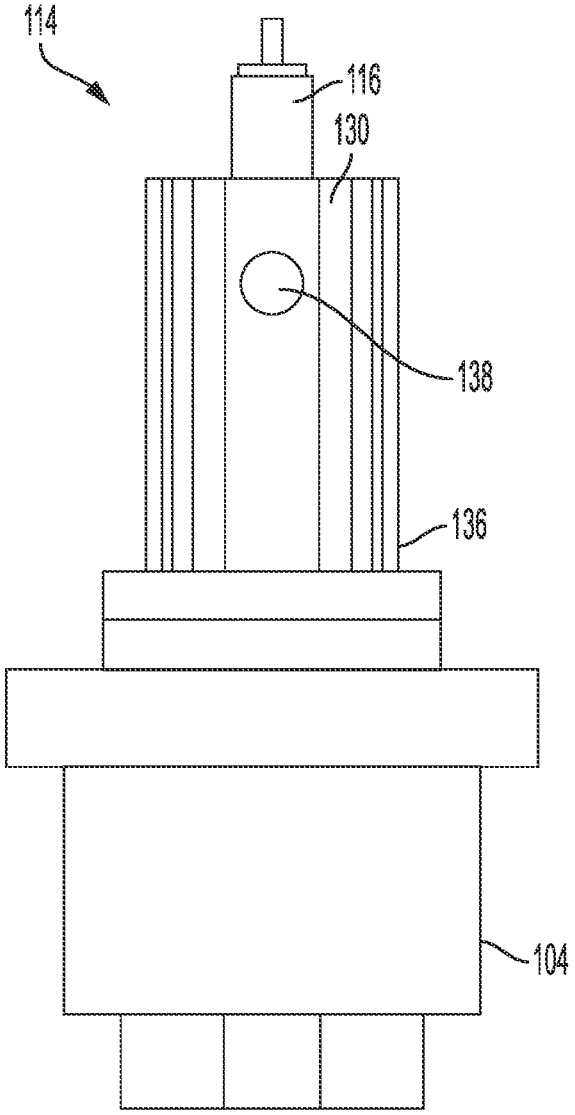
FIG. 6 is an isolated view illustrating a pump seal assembly for a serviceable pump for a deep fryer system according to the disclosure.
Figure 7:
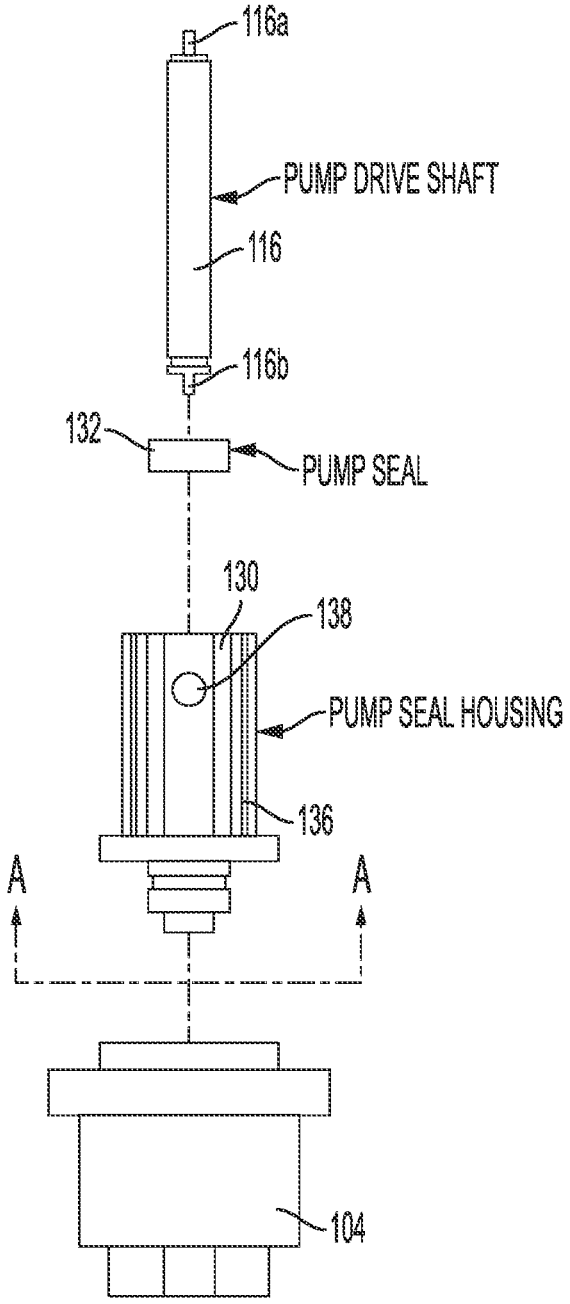
FIG. 7 is an exploded view illustrating the pump seal assembly of FIG. 6 for a serviceable pump for a deep fryer system according to the disclosure.
Figure 8:
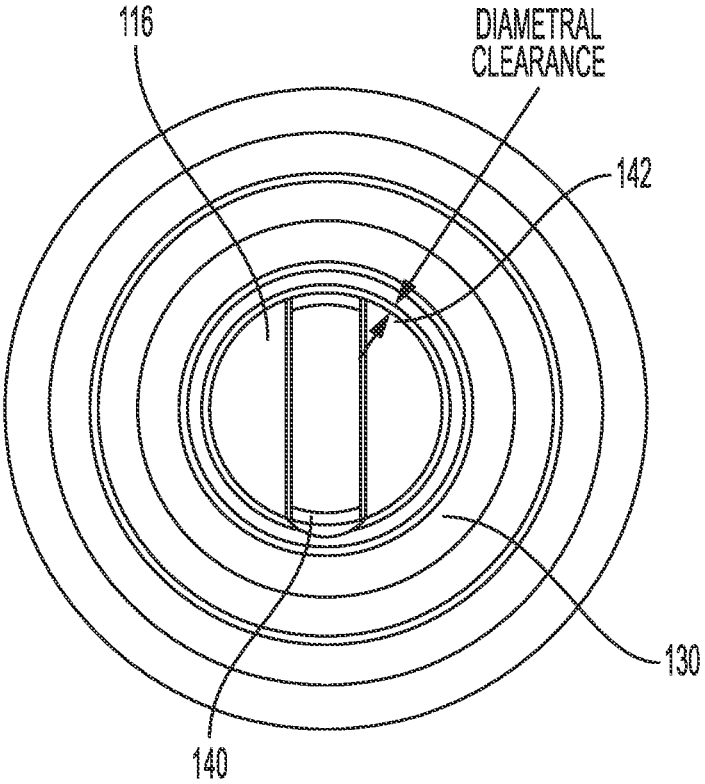
FIG. 8 is a top down perspective view along A-A of FIG. 7 illustrating the pump seal assembly for a serviceable pump for a deep fryer system according to the disclosure.
Figure 9A:
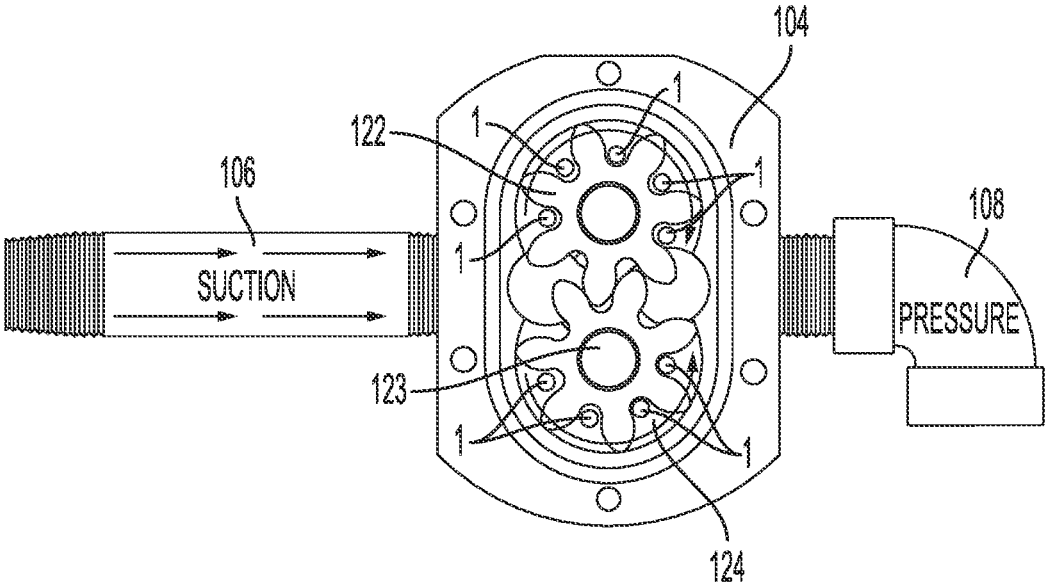
FIGS. 9A and 9B are internal views of a gear portion of the serviceable pump of FIG. 1 according to the disclosure.
Figure 9B:
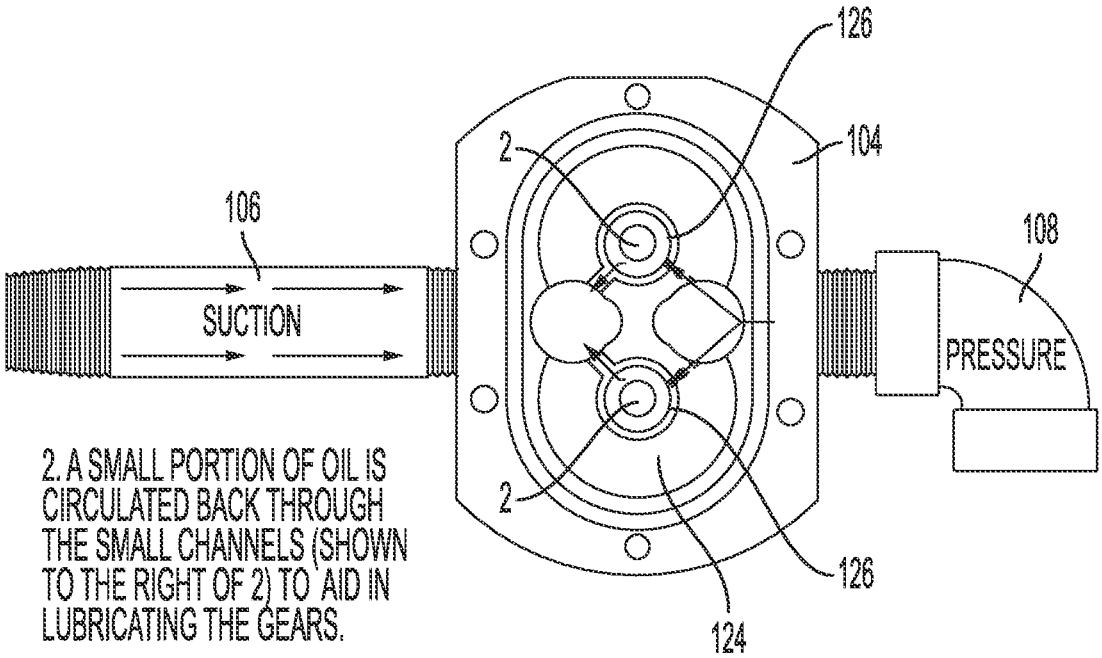

FIGS. 9A and 9B are detailed internal views of the gear portion 104 for the serviceable pump 100. As shown in FIG. 9A, cooking oil is pulled from the vat(s) of the deep fryer system and enters the gear portion through the oil suction port 106. The gear portion 104 may have a plurality of interlocked gears 122 adapted to continuously move the cooking fluid/oil within and through a gear cavity 124 with high volumetric efficiency. The interlocked gears 122 may also have gear shafts 123 coupled to the pump drive shaft 116 to drive the interlocked gears. Once the oil enters the gear portion 104, the movement of the gears 122 creates pressure and pushes the fluid around the gear portion 104 within the cavity 124. Further, the pressure may push a small amount of the cooking fluid into at least one small channel 126 (best seen in FIG. 9B), disposed beneath one or more gears of the gear portion 104, to help lubricate the gear(s) 122. The small amount of cooking oil may help limit degradation of the gear shafts 123 during operation of the pump to continuously circulate, filter, and maintain temperature of the cooking oil.

Figure 10:
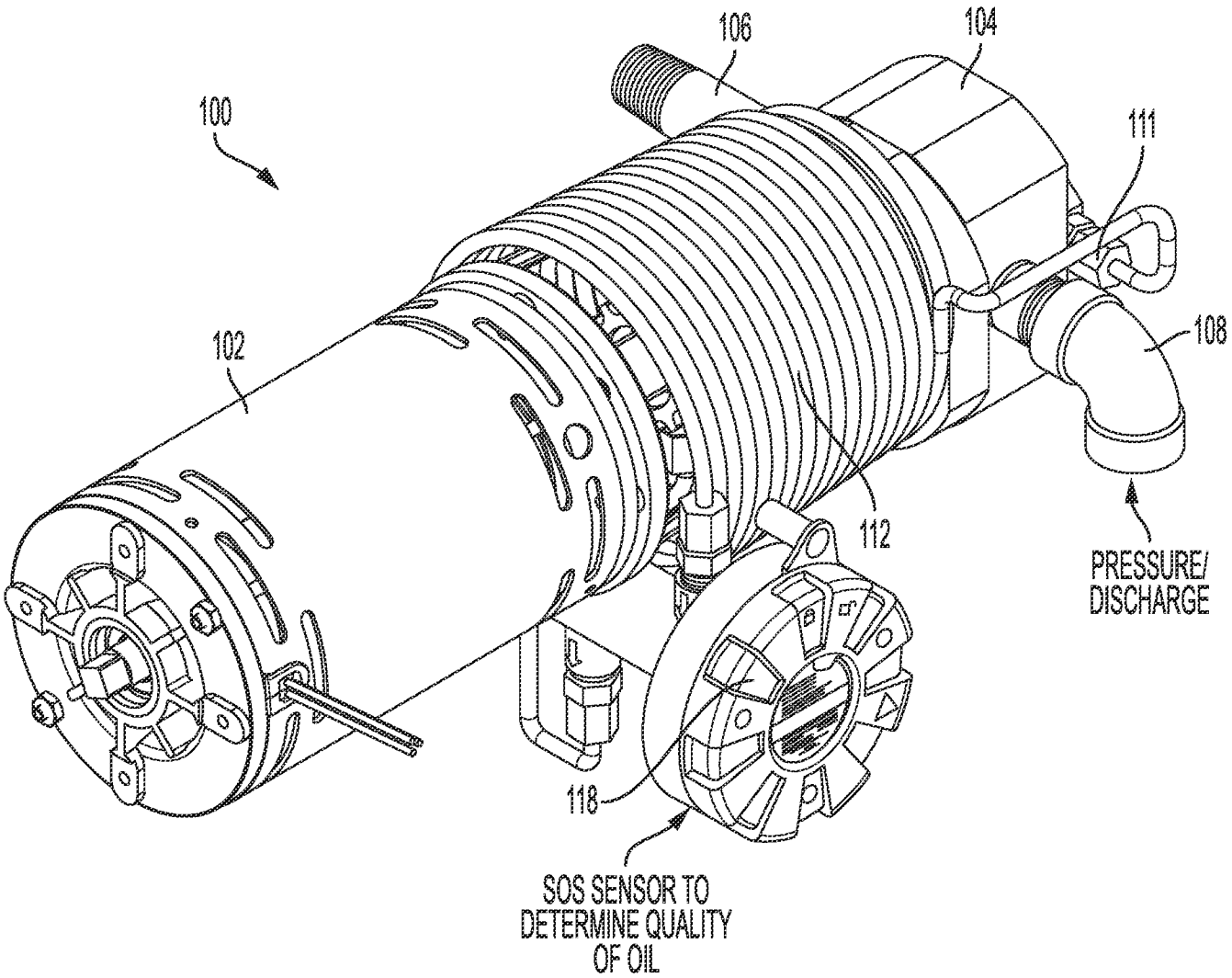
FIG. 10 is a further perspective view illustrating a serviceable pump for a deep fryer system having an oil quality sensor disposed in an oil cooling loop according to the disclosure.
Figure 11:
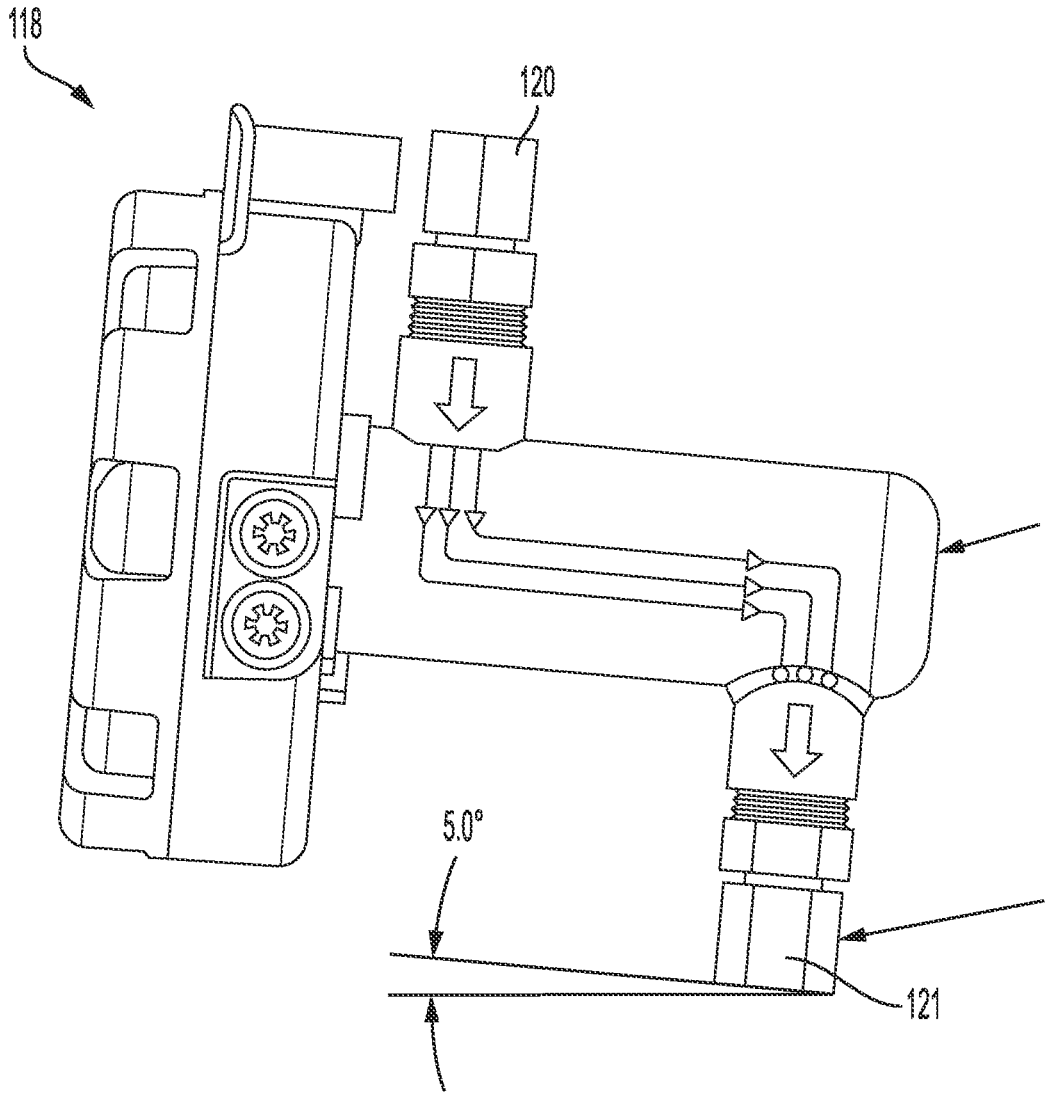
FIG. 11 is a view illustrating the oil quality sensor for the serviceable pump of FIG. 10 for a deep fryer system according to the disclosure.

Further, the serviceable pump 100 may also be integrated with an in-line oil quality sensor 118, shown in more detail in FIGS. 10 and 11. The oil quality sensor in this embodiment is disposed in the cooling loop of the serviceable motor, according to the disclosure, and is adapted to determine quality of the oil circulating within the pump 100, and more specifically in the cooling loop 112 of the serviceable circulation pump 100. The oil quality sensor 118 may be integrated with the pump 100 such that a first end 120 of the pump receives oil from the cooling loop 112 and a second end 121 of the pump returns oil to the cooling loop 112 for further lowering of the temperature of the oil. The oil quality sensor 118 may be disposed at an angle of about 3° to about 7° to prevent air from being trapped within the sensor 118. The oil quality sensor 118 may be any of various devices capable of sensing quality of oil passing through the sensor by measuring capacitance of the oil thereby measuring the percentage of total polar material (TPM) or total polar compounds (TPC), as known in the art. Oil quality sensors such as oil quality sensors available from Testo or Ebro, or the like, may be configured for use as described herein.

As shown and described, a controlled cooking system comprising a deep fryer may have cooking oil circulated out of the fryer vat for filtration/cleaning, using a pump such as described herein to circulate cooking oil from the fryer vat for filtration and back to the fryer vat after filtration. Additionally, the pump according to the disclosure uses a cooling loop to flow lower temperature oil through the cooling loop and portions of the serviceable pump in order to enhance the useful life of critical aspects of the pump, including the serviceable drive shaft and pump seals and pump seal assembly. Thus oil flows in several paths as a result of the configuration of the serviceable pump according to the disclosure. Specifically, oil is driven from the pressure side 108 of the pump 100 through a system loop including the cooking vats and back into the suction side 106 of the pump 100, for flow through the cooking system. In a second path, a portion of oil flows from the gear portion 104 through the cooling loop 112 and through the oil quality sensor 118 and back to the gear portion 104 of the pump 100.

While the pump assembly described above is depicted as used by a deep fryer, one of ordinary skill in the art should appreciate that other equipment may benefit from the assembly disclosed herein. Further, one of ordinary skill in the art would readily understand any appropriate modifications to the assembly disclosed herein for application with other equipment that could benefit from this assembly.

Those skilled in the art should appreciate that the serviceable pump described and illustrated may be housed in a unitary housing with panels accessible for servicing each of the components in the assembly system stack, or each component (motor, seal assembly, gear portion) could be segmented and fastened together from separately housed components to form the assembly stack.

References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

The use of any and all examples, or exemplary language ("e.g.," "such as," or the like) provided herein, is intended merely to better illuminate the embodiments and does not pose a limitation on the scope of the embodiments. No language in the specification should be construed as indicating any unclaimed element as essential to the practice of the embodiments.

While various embodiments are disclosed herein, it should be understood that the invention is not so limited and modifications may be made without departing from the disclosure. The scope of the disclosure is defined by the appended claims, and all devices that come within the meaning of the claims, either literally or by equivalence, are intended to be embraced therein.

What is claimed is:

1. A serviceable pump, comprising:

a motor disposed at a first end of the serviceable pump;

a pump shaft disposed between the motor and a gear portion, translating forces from the motor to the gear portion, the gear portion disposed at an end of the pump distal to the motor, the gear portion including a plurality of interlocking gears and a conduit disposed within the gear portion to circulate fluid through the gear portion, the gear portion receiving fluid from a fluid suction line connected to a first side of the gear portion and outputting fluid using a discharge aperture connected to a fluid discharge line, the gear portion including a cooling loop aperture disposed proximate to the discharge aperture, the gear portion further including at least one conduit disposed proximate to the plurality of interlocking gears receiving fluid to lubricate the plurality of interlocking gears when fluid is circulated through the gear portion;

a drain groove disposed between a pump seal housing and the pump shaft, the drain groove receiving a cooled fluid from an external cooling loop external to all elements of the serviceable pump using a pressure created by a movement of the gears;

the external cooling loop external to all elements of the serviceable pump and surrounding a pump seal assembly and the pump shaft, the external cooling loop external to all elements of the serviceable pump receiving fluid through the cooling loop aperture to be pushed into the external cooling loop external to all elements of the serviceable pump at a first end of the external cooling loop external to all elements of the serviceable pump, and to return the cooled fluid to the gear portion through the drain groove;

the pump seal assembly connected to the external cooling loop external to all elements of the serviceable pump and having a seal cavity that allows the cooled fluid to flow through the seal cavity and along the pump shaft before the cooled fluid returns to the gear portion through the drain groove.

2. The serviceable pump of claim 1, wherein the fluid is cooking oil.

3. The serviceable pump of claim 2, wherein the gear portion receives cooking oil from the fluid suction line connected to the first side of the gear portion and outputs fluid to a deep fryer cooking system.

4. The serviceable pump of claim 2, further comprising an oil quality sensor disposed in the external cooling loop external to all elements of the serviceable pump and adapted to determine a quality of the oil circulating within the external cooling loop.

5. The serviceable pump of claim 1, wherein the pump seal assembly comprises the pump seal housing, a pump seal and at least a portion of the pump shaft.

6. The serviceable pump of claim 1, wherein the seal assembly includes at least one cooling fin adapted to cool the cooking fluid in the external cooling loop.

7. A serviceable pump assembly for circulating a cooking fluid within a controlled cooking system, the serviceable pump assembly comprising:

a motor;

a pump shaft disposed between the motor and a gear portion and translating forces from the motor to the gear portion, the gear portion operatively coupled to the motor receiving the cooking fluid from and outputting the cooking fluid to a fryer vat of the controlled cooking system, the gear portion including a drain groove disposed between a pump seal housing and the pump shaft, the drain groove receiving a cooled cooking fluid from an external cooling loop external to all elements of the serviceable pump, using a pressure created by a movement of at least one gear of the gear portion ;

the external cooling loop external to all elements of the serviceable pump surrounding a pump seal housing and the pump shaft;

the external cooling loop external to all elements of the serviceable pump in fluid connection with the gear portion at a first end of the external cooling loop external to all elements of the serviceable pump, the external cooling loop external to all elements of the serviceable pump adapted to cool the cooking fluid received from the gear portion, the external cooling loop external to all elements of the serviceable pump connected to the pump seal housing; and a fluid quality sensor disposed in the external cooling loop external to all elements of the serviceable pump and adapted to determine a quality of the cooking fluid circulating within the external cooling loop external to all elements of the serviceable pump.

8. The serviceable pump assembly of claim 7, wherein the at least one gear of the gear portion comprises a plurality of interlocked gears pushing received cooking fluid through the gear portion; and the drain groove comprises a first end disposed at a first end of the pump shaft and a second end of the drain groove disposed at a second end of the pump shaft, wherein the drain groove defines an aperture along the pump shaft.

9. The serviceable pump assembly of claim 7, further comprising:

a seal assembly including a seal cavity in fluid connection with the external cooling loop external to all elements of the serviceable pump at a first end of a seal assembly of the pump seal housing and the gear portion at a second end of the seal assembly, the seal assembly receiving cooled cooking fluid from the external cooling loop external to all elements of the serviceable pump and outputting the cooled cooking fluid to the gear portion.

10. The serviceable pump assembly of claim 9, wherein the seal cavity surrounds the pump shaft and the cooled cooking fluid flows through the drain groove along the pump shaft through the seal cavity before returning to a gear cavity of the gear portion.

11. A serviceable pump assembly for circulating a cooking fluid within a controlled cooking system, comprising:

a motor;

a gear portion operatively coupled to the motor and receiving the cooking fluid from and outputting the cooking fluid to a fluid container of the controlled cooking system;

an external cooling loop external to all elements of the serviceable pump and surrounding a seal assembly and at least a portion of the pump shaft, the external cooling loop external to all elements of the serviceable pump in fluid connection with the gear portion at a first end of the external cooling loop external to all elements of the serviceable pump, the external cooling loop external to all elements of the serviceable pump cooling the received cooking fluid from the gear portion, the external cooling loop external to all elements of the serviceable pump connected to the seal assembly at a second end of the external cooling loop external to all elements of the serviceable pump; and wherein in a first fluid path the cooking fluid is driven from a pressure side of the serviceable pump through a system loop including a cooking vat of the controlled cooking system and back into a suction side of the serviceable pump for flow through the controlled cooking system, and wherein in a second fluid path a portion of the cooking fluid flows from the gear portion through the external cooling loop external to all elements of the serviceable pump and back to the gear portion of the serviceable pump through a drain groove disposed between the second end of the external cooling loop external to all elements of the serviceable pump and the gear portion of the serviceable pump.

12. The serviceable pump assembly of claim 11, further comprising a cooking fluid quality sensor disposed in the second fluid path and the portion of the cooking fluid flows from the gear portion through the external cooling loop external to all elements of the serviceable pump and the fluid quality sensor and through the drain groove back to the gear portion of the serviceable pump.

13. The serviceable pump assembly of claim 12, wherein the cooking fluid is cooking oil and the fluid quality sensor is an oil quality sensor.

14. The serviceable pump assembly of claim 13, wherein the fluid quality sensor is a capacitive oil quality sensor measuring a capacitance of the oil thereby measuring a percentage of one of total polar material (TPM) or total polar compounds (TPC).

15. The serviceable pump assembly of claim 11, wherein the gear portion comprises:

a plurality of interlocked gears pushing received cooking fluid through the gear portion; and the plurality of interlocked gears sucking the cooking fluid from the drain groove.

16. The serviceable pump assembly of claim 11, further comprising:

the seal assembly with a seal cavity in fluid connection with the external cooling loop external to all elements of the serviceable pump at a first end of the seal assembly and the gear portion at a second end of the seal assembly, the seal assembly comprising a pump seal housing, a pump seal and a pump shaft and receiving cooled cooking fluid from the external cooling loop external to all elements of the serviceable pump and outputting the cooled cooking fluid to the gear portion.

17. The serviceable pump assembly of claim 16, wherein the seal cavity surrounds the pump shaft and the cooled cooking fluid flows along the pump shaft through the drain groove before returning to a gear cavity of the gear portion.

* * * * *